US005225616A

United States Patent [19]

Bakeman

[11] Patent Number: 5,225,616

[45] Date of Patent: Jul. 6, 1993

[54] MUSICAL CHIME

[76] Inventor: Charles K. Bakeman, 15718-126th Pl. N.E., Woodinville, Wash. 98072

[21] Appl. No.: 850,660

[22] Filed: Mar. 12, 1992

[51] Int. Cl.[5] ..... G10D 13/08; G10K 5/00; A63H 5/00

[52] U.S. Cl. ..... 84/404; 116/141; 446/418

[58] Field of Search ..... 84/404, 402, 403; 116/141, 169; 368/273; D17/22; 446/418, 419; 312/351.3

[56] References Cited

U.S. PATENT DOCUMENTS

| | | | |
|---|---|---|---|
| 408,635 | 8/1889 | Sommer | 84/404 |
| 1,575,960 | 3/1926 | Bartholomae | 84/403 |
| 1,586,769 | 6/1926 | Askin | 84/403 |
| 2,454,402 | 11/1948 | Okrain | 84/404 |
| 2,504,456 | 4/1950 | Rundell | 84/404 |
| 2,504,457 | 4/1950 | Rundell | 84/404 |
| 2,738,697 | 3/1956 | Miller | 84/404 |
| 2,932,122 | 2/1960 | Inman | 446/168 |
| 3,110,532 | 12/1963 | Nail | 312/351.3 |
| 3,208,409 | 9/1965 | Gale | 312/351.3 |
| 4,901,617 | 2/1990 | Malone et al. | 84/402 |

OTHER PUBLICATIONS

Japanese Noise Maker (see attached photographs and discussion on pp. 3 and 4 of the pending patent application).

*Primary Examiner*—Michael L. Gellner
*Assistant Examiner*—Cassandra Spyrou
*Attorney, Agent, or Firm*—Craine & Vance

[57] ABSTRACT

Apparatus and processes to generate random musical notes at random intervals over a relatively long period of time without intervention by a musician by causing a plurality of chime beads to fall under the force of gravity from an elevated adhesive strip onto a plurality of chime bars positioned in a stepped, chevron-shaped configuration.

18 Claims, 6 Drawing Sheets

44
44
46
46
47
34
44
47
44
46
46
47
47
36
47
52
20
50′
47
30
52
42
28
48
52
48
60
56
36′
50
28
56
56
60
28′
60
56
56
68
70
22
56
56
68′
60
60
70
68″
28′
58′
32
56
60
28′
70
62
56
62
38
38
66
40
26
52
58
38

MUSICAL CHIME

TECHNICAL FIELD

This invention relates to musical chimes. More particularly, this invention relates to apparatus and methods for using gravity to generate a plurality of high quality, random musical notes at random intervals over a relatively long period of time without intervention by a musician.

BACKGROUND OF THE INVENTION

The world has known a wide variety of differently configured chimes which produce various sounds. For instance, wind chimes typically comprise a plurality of vertically oriented bars or tubes which hang from an even higher support surface. In their simplest form, such chimes simply hang until a force of passing air urges the bars or tubes to impact against one another, thereby creating random sounds.

In a more complex version, the wind chime has a hammer that is centrally located amidst the vertically oriented bars. The hammer is attached to means that is urged into motion by the force of passing air. Once set in motion, such means causes the hammer to impact against one or more of the vertically oriented bars or tubes to create random sounds.

Vertically oriented bars or tubes of successively increasing length are used in a planar fashion to form a musical instrument called tubular bells. A musician uses one or more mallets to manually strike the bells.

Another musical instrument which uses bars or tubes of successively increasing length is a xylophone. Such bars or tubes, however, have a horizontal orientation. Vertically oriented resonators are often secured to the bars. The bars are individually struck by a musician using one or more mallets. To facilitate ease of use, the bars are positioned to produce successive musical notes similar to the placement of keys on a piano. The inventor is aware of the following references which relate to xylophone devices: Bartholomae (U.S. Pat. No. 1,575,960; issued Mar. 9, 1926), and Okrain (U.S. Pat. No. 2,454,402; issued Nov. 23, 1948).

Many other sound producing devices have also been created. The following references relate to such devices: Rundell (U.S. Pat. No. 2,504,456; issued Apr. 18, 1950); Rundell (U.S. Pat. No. 2,504,457; issued Apr. 18, 1950); Miller (U.S. Pat. No. 2,738,697; issued Mar. 20, 1956); Askin (U.S. Pat. No. 1,586,769; issued Jun. 1, 1926); and Sommer (U.S. Pat. No. 408,635).

In contrast, Inman (U.S. Pat. No. 2,923,122; issued Feb. 2, 1960) relates to a vibration producing device.

The inventor is also aware of a noise making device which is believed to have been sold in Japan. The device comprises an upright, transparent, elongated cylinder or tube having end caps at each end. Located within the interior of the cylinder at its lower end are three spaced, circular, metal discs. The three metal discs are connected together by a centrally located support rod extending upwardly from the lower end or base of the cylinder. Each disc is circular in configuration and has a convexo-concave configuration. The discs increase in diameter from the uppermost disc to the lowermost disc. The lowermost end cap has a floor and a raised cylindrical sidewall. The lowermost end cap is made of metal and has uniform perforations therein. An adhesive strip is secured to the interior side of the upper end cap or lid. Ball bearings are placed within the interior cavity of the cylinder. When turned upside-down, the ball bearings adhere to the adhesive strip. When turned right-side-up, the ball bearings gradually drop from the adhesive strip to impact against the metal discs. The central placement of the discs within the cylinder causes the ball bearings to ricochet of the discs and impact against an interior sidewall of the transparent cylinder. The ball bearings then impact against the metal floor of the lowermost end cap.

The inventor believes that the listed references taken alone or in combination neither anticipate nor render obvious the present invention. Citation of these references does not constitute an admission that such disclosures are relevant or material to the present claims. Rather, such relate only to the general field of the disclosure and are cited as constituting the closest art of which the inventor is aware.

DISCLOSURE OF INVENTION

In designing the present invention, the inventor wanted to create a musical chime which would be simplistic, have good tone quality, and would generate random musical notes at random intervals over a relatively long period of time without intervention by a musician. Furthermore, the inventor wanted the musical chime to be sufficiently compact in size to be placed unobtrusively upon a person's desk, table, and/or counter. Prior, during, and after operation of the musical chime, the simplistic and attractive appearance of its cabinet and placement of chime bars therein would impart artistic elegance to the device, invite closer inspection, and be a topic of conversation.

The present invention includes apparatus and processes that cause a plurality of chime beads to fall under the force of gravity from an elevated adhesive strip onto a plurality of generally horizontally oriented chime bars positioned in a stepped, chevron-shaped configuration.

To accomplish the foregoing and other objectives, the musical chime comprises: a cabinet defining an enclosure; an adhesive strip; a plurality of chime beads; and a plurality of chime bars.

The cabinet comprises: a base; one or more sidewalls; and a top. Furthermore, the cabinet may also comprise: (1) one or more support legs or feet; (2) one or more scratch resistant pads positioned between the support legs and an underlying surface; (3) sidewalls having one or more apertures or holes therein to allow additional escape of resonating sounds; (4) a top which defines a removable lid; (5) one or more openings through which the interior workings of the invention may be observed; (6) one or more transparent or translucent windows positioned within such openings; (7) a plurality of taut cords which support and suspend the chime bars within the enclosure in a stepped, chevronwise pattern; (8) two or more support members having a generally stepped configuration which generally converge toward each other near the base upon which the taut cords are secured and supported; and (9) means for absorbing undesired impact of the chime beads against the cabinet.

The plurality of chime bars are positioned within the enclosure below the top of the cabinet and adhesive strip. The chime bars are secured to the cabinet within the enclosure in a suspended, spaced, generally horizontal orientation. More particularly, the plurality of chime bars are secured to the cabinet in a suspended, spaced, parallel, stepped, symmetrical, horizontally oriented, generally chevronwise, chevron-shaped, or V-shaped pattern or configuration. This pattern allows the chime beads to fall from the adhesive strip to impact against an upwardly positioned chime bar and then fall onto one or more chime bars located at lower positions.

In the preferred embodiment, each of the chime bars has a different length than the remaining chime bars. Furthermore, the chime bars are positioned within the stepped, chevron-shaped configuration in such a manner that the length of the chime bars decreases with each successive step downward toward the base.

Each of the above-mentioned elements and their interaction with one another will be discussed and elaborated upon in the detailed description below.

The present invention achieves each of the above-stated objectives and overcomes the foregoing annoying disadvantages and problems. These and other objectives and advantages of the present invention will become more readily apparent upon reading the following disclosure and referring to the attached drawings.

Figure 1:
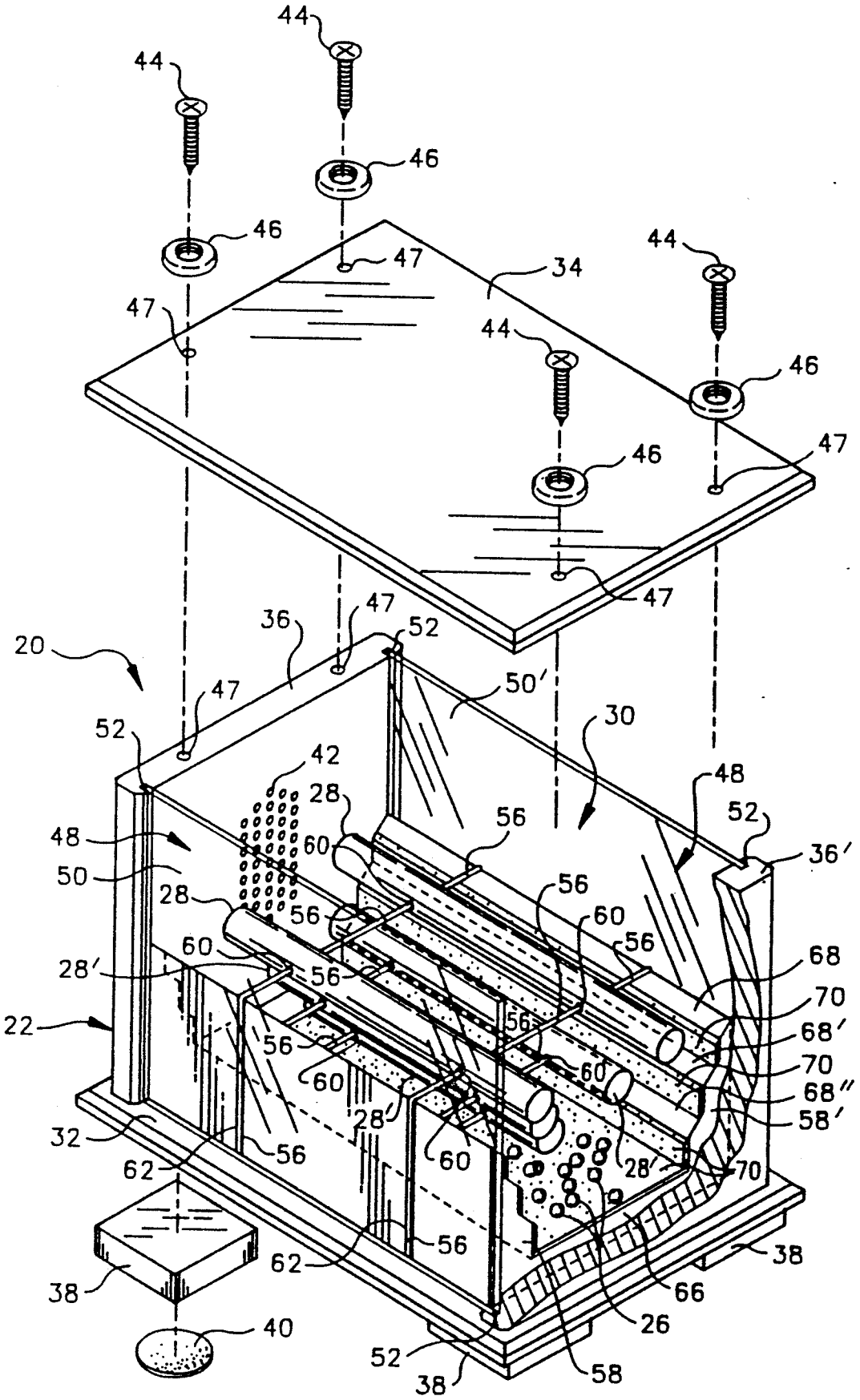
FIG. 1 is a partial, cross-sectional, exploded, isometric view of the present invention.
Figure 2:
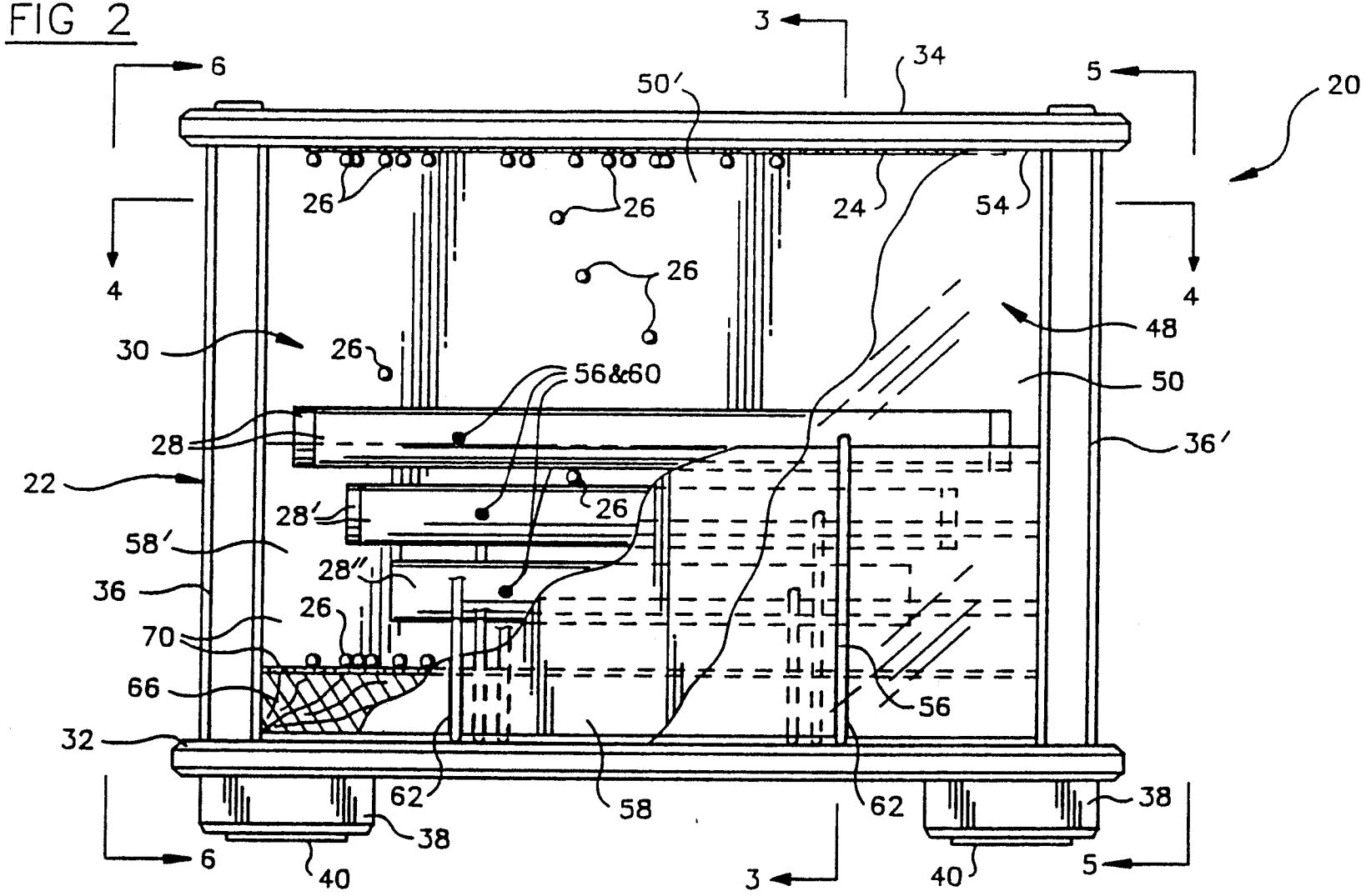
FIG. 2 is a partial, side-elevational view of the invention illustrated in FIG. 1, showing the chime beads falling under the force of gravity from the adhesive strip onto the chime bars.

One should understand that the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Referring to the drawings, wherein like numerals indicate like parts, musical chime 20 of the present invention comprises: (a) a cabinet 22; (b) an adhesive strip 24; (c) a plurality of chime beads 26; and (d) a plurality of chime bars 28.

CABINET

Cabinet 22 is intended to be placed upon any desired support surface (not shown). The size and shape of cabinet 22 are largely dependent upon the aesthetic effect desired and the quantity and duration of the musical notes to be generated. As previously stated, the simplistic and attractive appearance of cabinet 22 and placement of chime bars 28 therein should impart artistic elegance to musical chime 20, invite closer inspection, and be a topic of conversation.

As illustrated in the accompanying drawings, cabinet 22 depicts the preferred embodiment of the invention. Other configurations and designs could be equally effective in accomplishing the purposes of this invention.

In essence, cabinet 22 defines an enclosure 30 within which most of the other elements of the invention are contained. Cabinet 22 has a base 32, a top 34, and at least one sidewall 36 which define enclosure 30. In its operational position, top 34 must be elevated above base 32.

During operation, base 32 is placed upon the underlying support surface.

Base 32 may be provided with one or more support legs 38 or feet which are positioned between base 32 and the underlying support surface. Support legs 38 elevate base 32 above the support surface. Support legs 38 are secured to base 32 by any appropriate means, such as by adhesion, use of screws, nails, bolts, or the like.

Base 32 could further include one or more scratch resistant pads 40 positioned between support legs 38 and the underlying support surface. Scratch resistant pads 40 could be secured directly to support legs 38 or, alternatively, be secured to base 32 or to sidewalls 36, as long as the desired task of protecting the underlying support surface against being scratched or marred is achieved.

Cabinet 22 also has one or more sidewalls 36. It is preferable that sidewall 36 be generally upright and be secured to or juxtaposed against the underlying, horizontally oriented base 32.

In the preferred embodiment, cabinet 22 has at least two parallel, spaced sidewalls 36 and 36 . Sidewalls 36 and 36' further define enclosure 30.

Figure 5:
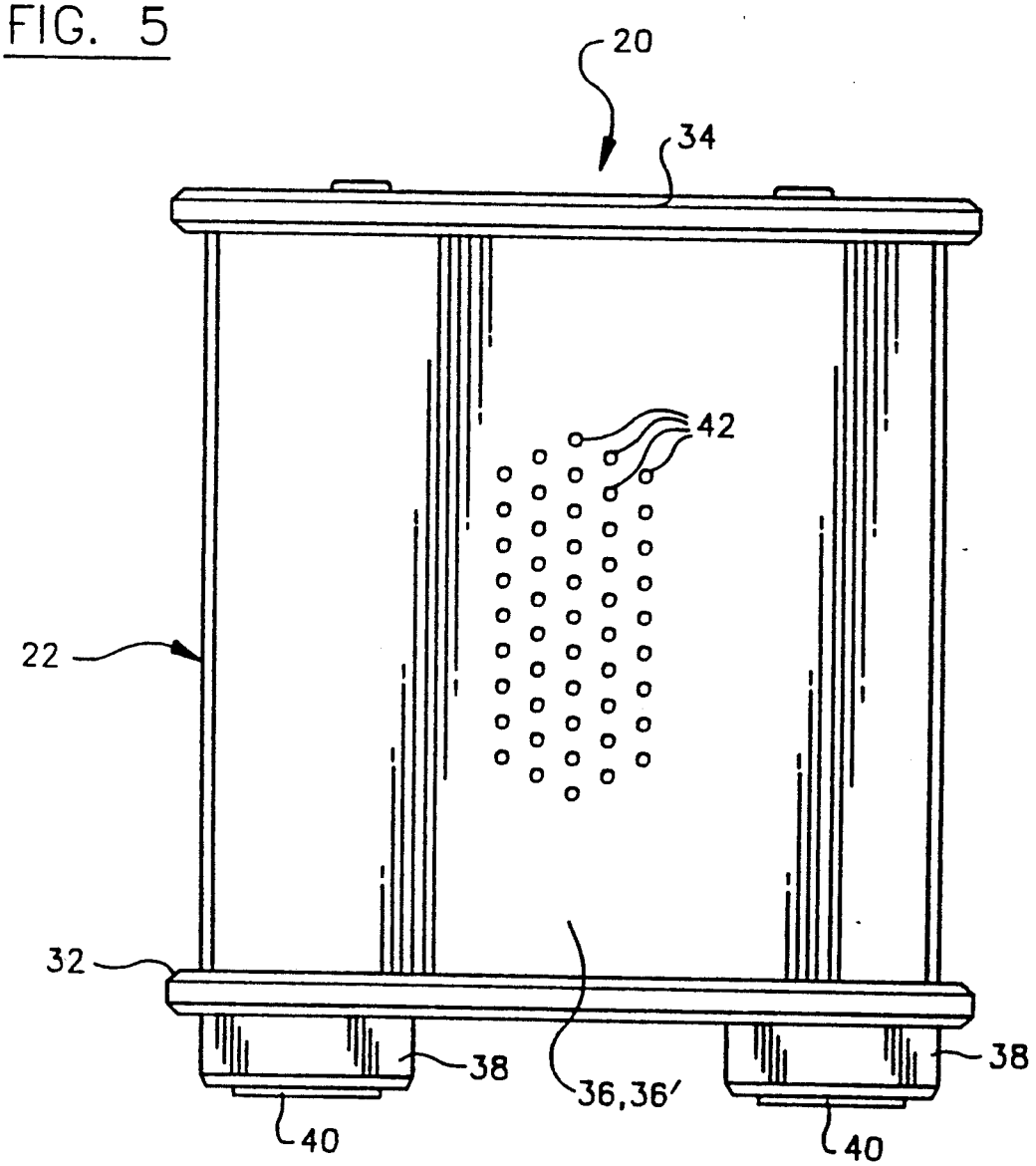
FIG. 5 is an end-elevational view of the invention as seen along a plane defined by either line 5—5 and/or line 6—6 in FIG. 2.

As illustrated in FIGS. 1 and 5, sidewalls 36 and 36' may have one or more apertures 42 or holes therein. Apertures 42 permit the increased escape of resonating musical notes from within enclosure 30.

Top 34 generally assumes a horizontal, parallel, spaced orientation with respect to base 32. If desired, however, top 34 and/or base 32 may be inclined with respect to the underlying support surface. Top 34 is secured to sidewalls 36 and 36' by any appropriate means.

In the preferred embodiment, top 34 is removably secured to sidewalls 36 and 36' by any appropriate means, such as with screws 44, bolts, nuts, clasps, interlocking elements, or the like. Countersunk, flush, or flat washers 46, or the like, may be used in conjunction with the insertion of screws 44 into receiving holes 47. Washers 46 also give greater strength to the attachment and/or enhance the aesthetic appearance of the attachment. Thus attached, top 34 serves as a removable lid for cabinet 22.

To enhance the quality of the resonating musical notes generated by musical chime 20, cabinet 22 should be made of wood. Alternatively, cabinet 22 may be made of plastic or other materials and still accomplish the objectives of the present invention.

If desired, cabinet 22 may also be provided with one or more openings 48 through which the interior workings of musical chime 20 may be observed. In other words, openings 48 permit persons to observe the operation of musical chime 20. Openings 48 may also be covered with a transparent or translucent window 50 made of glass, thermoplastic such as PLEXIGLASS, or the like.

Sidewalls 36 and 36' could have one or more transparent or translucent windows 50 and 50', respectively, positioned within openings 48.

As seen in FIGS. 1 through 4, windows 50 are preferably positioned between base 32 and top 34 of cabinet 22 Slots 52 may be provided within sidewalls 36 and 36' to receive and retain the vertical edges of windows 50 and 50'. Thus positioned, windows 50 and 50' shall be oriented generally upright and orthogonal to top 34 and base 32. If windows 50 are used, windows 50 further define enclosure 30. If two transparent or translucent windows 50 and 50' are used, windows 50 and 50' can be positioned in a generally parallel, spaced relationship to one another.

ADHESIVE STRIP

Adhesive strip 24 is positioned within enclosure 30 and is secured or adhered to an inner or interior surface 54 of top 34.

In the preferred embodiment, the adhesive strip 24 is formed from a strip of double sided, high-tack/low-tack, adhesive film sold by 3M Corporation under the product number 9415.

In an alternative embodiment, adhesive strip 24 may be secured to a removable cartridge (not shown) that in turn is secured or urged against interior surface 54 of top 34.

PLURALITY OF CHIME BEADS

When chime beads 26 are placed within enclosure 30 and cabinet 22 is inverted, chime beads 26 contact and become temporarily adhered to adhesive strip 24. Force of gravity acts to pull chime beads 26 away from adhesive strip 24 to fall from top 34 toward base 32 of cabinet 22.

In other words, the plurality of chime beads 26 are capable of being selectively adhered to and randomly removed by gravity from adhesive strip 24. Thus, during operation of musical chime 20, the plurality of chime beads 26 initially adhere to adhesive strip 24 and subsequently fall in a random pattern from adhesive strip 24 under the influence of gravity.

Chime beads 26 are preferably manufactured from stainless steel and comprise relatively small spherical orbs. Alternatively, chime beads 26 may be manufactured from a different metal, or from plastic, wood, or the like.

PLURALITY OF CHIME BARS

The plurality of chime bars 28 are secured to the cabinet 22 within the enclosure 30 below top 34 and adhesive strip 24 in a suspended, spaced, generally horizontal orientation. More particularly, chime bars 28 are secured to cabinet 22 in a suspended, spaced, parallel, stepped, symmetrical, horizontally oriented, generally chevronwise, chevron-shaped, or V-shaped pattern or configuration. This pattern allows chime beads 26 to fall from adhesive strip 24 to impact against an upwardly positioned chime bar 28 and then fall onto one or more chime bars 28' and/or 28" located at lower positions.

In the preferred embodiment, each of chime bars 28, 28', and 28" has a different length. Furthermore, chime bars 28, 28', and 28" are positioned within a stepped, chevron-shaped configuration in such a manner that the length of chime bars 28, 28', and 28" decreases with each successive step downward toward base 32.

During operation, chime beads 26 randomly fall from the adhesive strip 24 onto chime bars 28, 28', and 28" to produce a variety of different musical notes depending upon which chime bar 28, 28', or 28" is struck.

The particularly described pattern or configuration of chime bars 28, 28', and 28" allows many of chime beads 26 to impact against an upwardly positioned chime bar 28 or 28' and then fall onto one or more chime bars 28' and/or 28" located at lower elevations or positions without impacting against the interior sidewall 36 or window 50 of the cabinet 22.

Similarly, chime beads 26 may strike a lower chime bar 28' or 28" and rebound upwardly or sideways to strike one or more other chime bars. This imparts greater variety to the possible pattern of notes generated by the path of a single chime bead 26.

TAUT CORDS

To accommodate the suspension of chime bars 28 within enclosure 30, taut cords 56 may be stretched between and secured to opposite sidewalls 36 and 36' of the cabinet 22.

In the preferred embodiment, however, additional support members 58 and 58' are provided within enclosure 30. Support members 58 and 58' are positioned adjacent windows 50 and 50' and are secured to either base 32 and/or to sidewalls 36 and 36'. In essence, support members 58 and 58' provide a support framework across which taut cords 56 may be stretched and supported. Support members 58 and 58' will be discussed in greater detail below.

In short, chime bars 28, 28', and 28" may be suspended upon spaced horizontally oriented taut cords 56 that in turn are secured to cabinet 22. Consequently, chime bars 28 would assume a generally horizontal orientation during operation.

Attachment of chime bars 28, 28' and 28" to taut cords 56 may be accomplished by any one or more of many different means. The inventor prefers to secure chime bars 28, 28', and 28" to their respective taut cords 56 and thereby prevent inadvertent translational movement of chime bars 28, 28', and 28" along the cords 56. This may be done by simply using a cyanoacrylate adhesive or other glue that hardens to secure the chimes bars 28, 28', and 28" in place.

In the preferred embodiment, each chime bar 28, 28', and 28" has at least two bore holes 60 therethrough. Bore holes 60 are generally parallel to each other and are perpendicular to the longitudinal axis of the chime bars 28, 28', and 28". Bore holes 60 are also spaced apart, and taut cords 56 are passed therethrough. Thus positioned, taut cords 56 provide means for supporting and allowing chime bars 28, 28', and 28" to resonate.

Please note that each taut cord 56 may pass through bore hole 60 of one or more chime bars 28, 28', and/or 28". In the preferred embodiment, the four uppermost taut cords 56 pass through and support the two uppermost chime bars 28, and the two middle positioned chime bars 28', respectively. The lowermost taut cord supports the single chime bar 28".

SUPPORT MEMBERS

In addition to the above-stated elements, cabinet 22 may further comprise at least two spaced, parallel oriented, support members 58 and 58'. Support members 58 and 58' may be secured to base 32 and/or to sidewalls 36 and 36'. Support members 58 and 58' further define enclosure 30. Support members 58 and 58' preferably have an orthogonal orientation with respect to base 32, top 34, and sidewalls 36 and 36'.

Support members 58 and 58' may have one or more generally vertical, horizontal, and/or inclined channels 62 and/or bore holes 64 therein through which the various taut cords 56 may pass. Securement of the various taut cords 56 to cabinet 22 prevents longitudinal movement of the cords 56 within channels 62 and bore holes 64.

Figure 3:
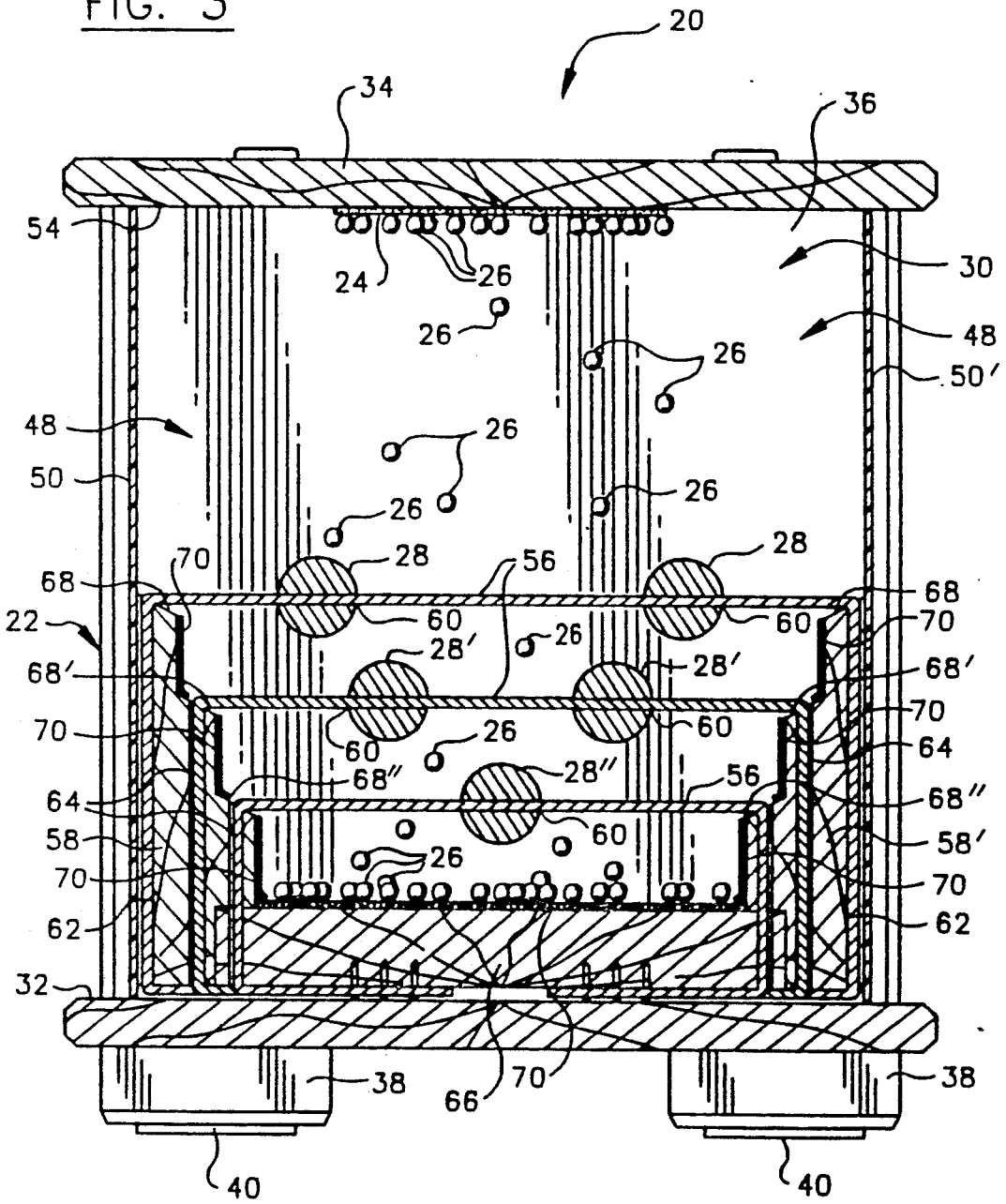
FIG. 3 is a cross-sectional, side-elevational view of the invention taken through a plane defined by line 3—3 in FIG. 2 with the apertures removed or at least not appearing.
Figure 4:
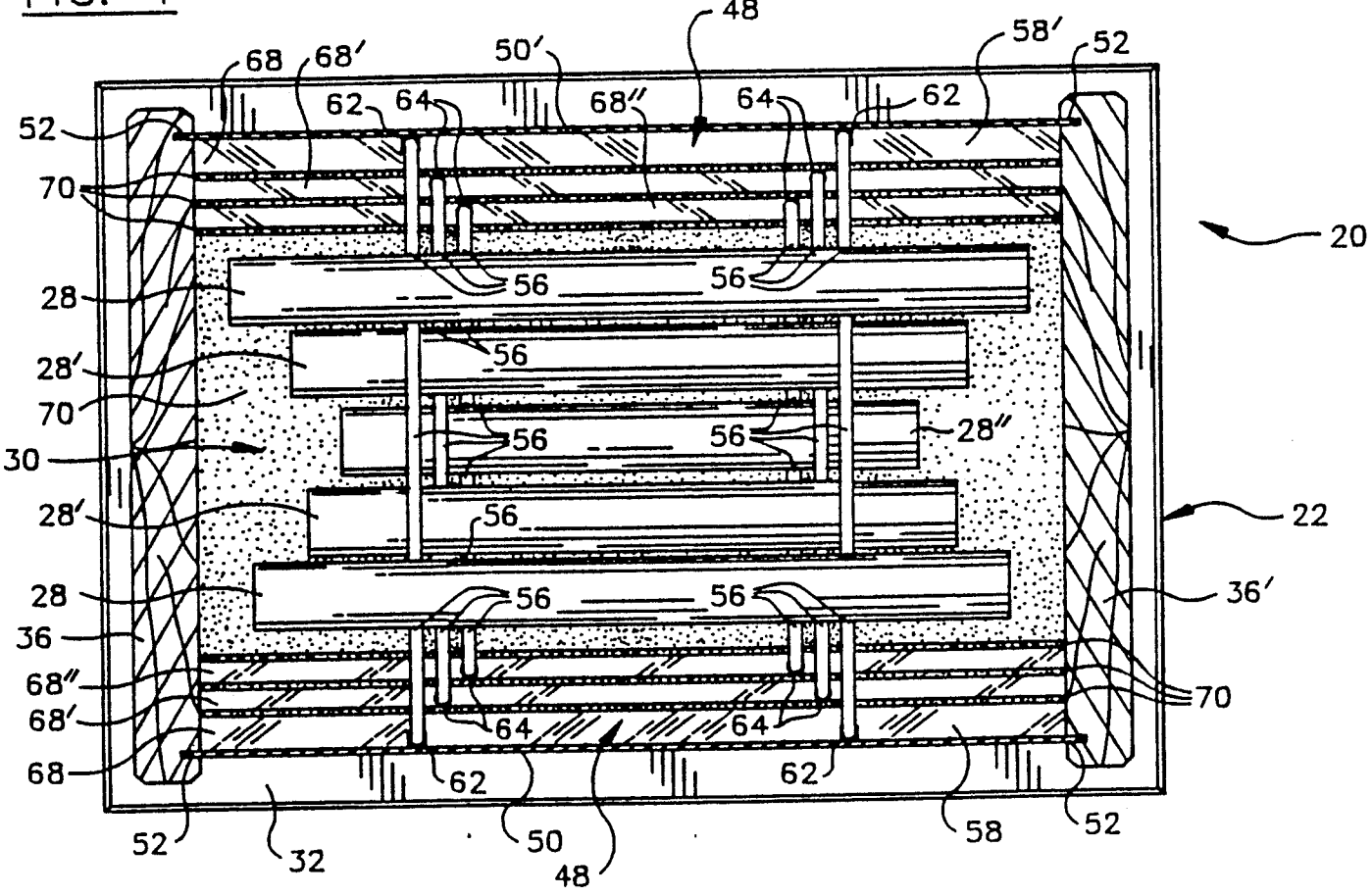
FIG. 4 is a cross-sectional, plan view of the invention taken through a plane defined by line 4—4 in FIG. 2 with the chime beads removed.

As illustrated in FIG. 3, base 32 may further comprise a raised floor 66 to which support members 58 and 58 , and possibly taut cords 56 are secured.

With the cabinet 22 thus configured, taut cords 56 may successively be: (a) secured directly to raised floor 66 or to first support member 58, (b) passed through vertical channels 62 and/or bore holes 64 within first support member 58, (c) passed through bore holes 60 within one or more chime bars 28, 28', and/or 28'', (d) spanned across the remaining width or distance within enclosure 30, (e) passed through vertical channels 62 and/or bore holes 64 of second support member 58', (f) stretched taut, and (g) secured directly to either raised floor 66 or to second support member 58' in such a manner that cord 56 remains taut between first and second support members 58 and 58', and chime bars 28, 28', and 28'' are suspended within enclosure 30.

Support members 58 and 58' may further have a generally stepped configuration which generally converge toward each other near base 32. Each successive step 68, 68 , and 68'' of the layered support members 58 and 58' may be used to support a different pair or set of taut cords 56 and one or more chime bars 28, 28' or 28''. In the illustrated preferred embodiment, step 68 is used to support chime bar 28. Step 68' is used to support chime bar 28'. Step 68'' is used to support chime bar 28''. The successive steps 68, 68', and 68'' of the layered support members 58 and 58' also provide additional aesthetic and sculptural impact to musical chime 20.

In an alternative embodiment (not shown), interior sidewalls 36 and 36' of cabinet 22 may also have spaced, layered steps 68, 68', and 68''.

Figure 6:
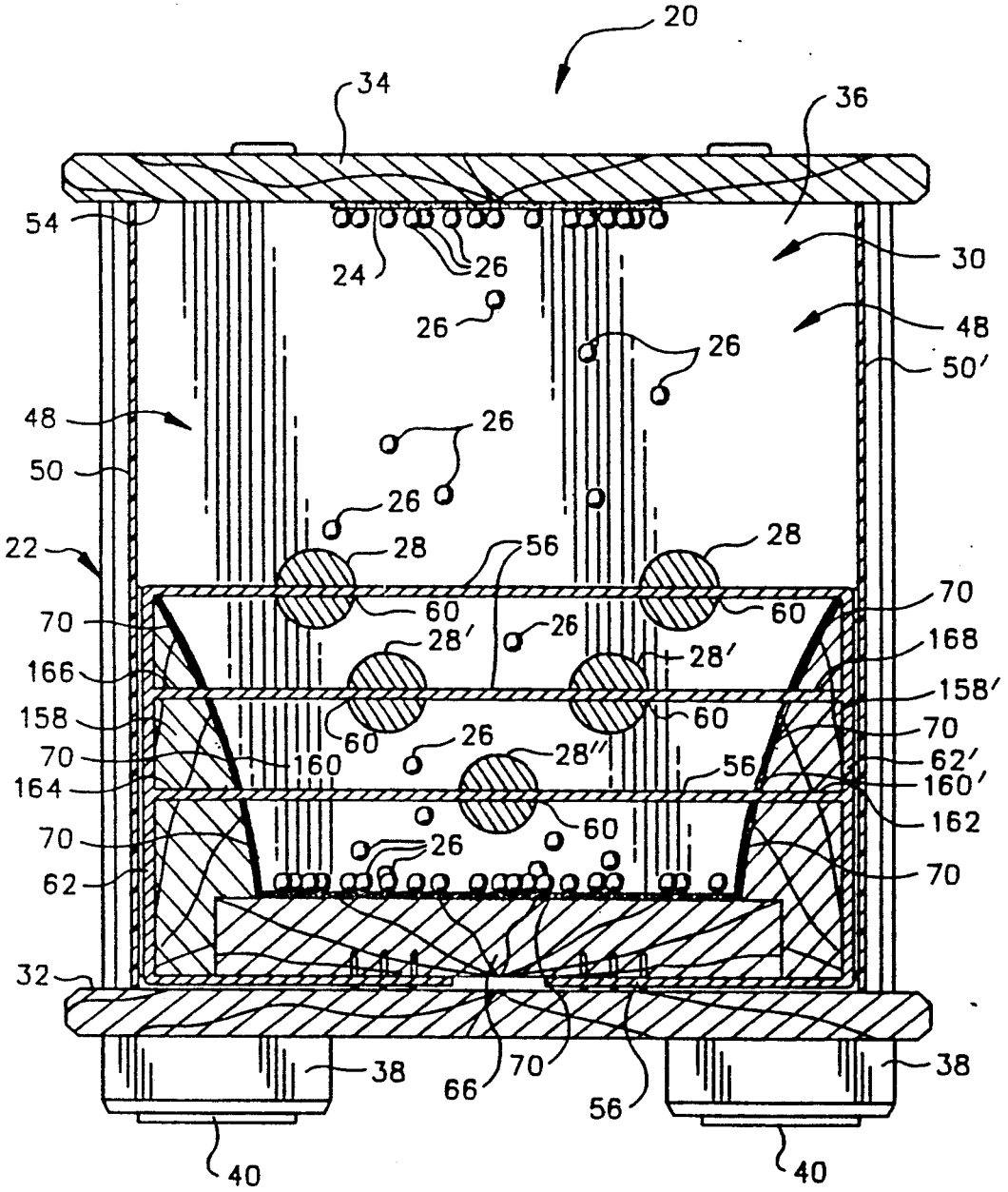
FIG. 6 is a cross-sectional, side-elevational view of an alternative embodiment of the present invention, as seen along a plane similar to that of FIG. 3.

In a further embodiment, as illustrated in FIG. 6, support members 158 and 158' may be formed to have an respectively. Taut cord 56 is laced or threaded through vertically oriented channels 62 and 62' and through horizontally oriented bore holes 162, 164, 166, and 168 to support chime bars 28, 28', and 28''. More specifically, taut cord 56 is laced back and forth through support members 158 and 158' in a serpentine fashion as illustrated. This embodiment eliminates many otherwise necessary steps in the manufacture of musical chime 20. Interior arcuate planar surfaces 160 and 160' may then be covered with shock-absorbant material 70.

SHOCK-ABSORBENT MEANS

Musical chime 20 may further comprise means for absorbing undesired impact or shock of chime beads 26 hitting against cabinet 22. For example, base 32, raised floor 66 (if used), sidewalls 36 and 36', and support members 58 and 58' may each be padded to absorb the impact of the falling chime beads 26.

More particularly, the interior surfaces of raised floor 66 and support members 58 and 58' may be coated with a shock-absorbent material 70, such as with a closed cell urethane foam sheeting, open cell foam sheeting, rubber, or fabric sheeting material. Shock-absorbent material 70 absorbs and cushions the impact of chime beads 26 when anything other than chime bars 28, 28', and 28'' are impacted. The impact- or shock-absorbent material 70 may be adhered, secured, or otherwise affixed to cabinet 22 by any appropriate means.

Since each suspended chime bar 28, 28', and 28'' has a different length, a different tone or pitch is generated when each respective chime bar 28, 28', or 28'' is struck. The suspension and differences in lengths of chime bars 28, 28', and 28'' also impart an aesthetically appealing appearance to the interior workings and structure of musical chime 20. When such suspension feature and the differences in lengths are combined with the chevron-shaped configuration or pattern of the chime bars 28, 28', and 28'', an intriguing interior sculpture is formed which invites close inspection and continued observation.

In another embodiment of the present invention, rather than using chime bars 28, 28', and 28'' having different lengths to produce different pitches, instead, the diameters, tubular or rod shapes, extra attachments and/or removal of material, mass, and/or material used may each be altered to generate the desired variety of muscial pitches.

During operation, cabinet 22 is inverted so that gravity urges chime beads 26 to contact and become adhered to adhesive strip 24. Cabinet 22 is then placed right-side-up and set upon a desk or other support surface. Gravity urges chime beads 26 away from adhesive strip 24 to fall and impact upon one or more of the horizontally spaced chime bars 28, 28', and/or 28''. In addition, a user of musical chime 20 may shake cabinet 22 to further urge chime beads 26 to fall from adhesive strip 24.

When the randomly falling chime beads 26 fall from adhesive strip 24, chime beads 26 strike the horizontally oriented chime bars 28, 28', and/or 28'' in a random pattern at random times, thereby generating random musical notes.

The described and illustrated invention further accommodates easy gripping and manipulation by a user, and can be easily operated by even a young child.

In addition, the various exterior surfaces of base 32, sidewalls 36 and 36', support members 58 and 58', windows 50 and 50', and top 34 may all serve as surfaces upon which instructional, trademark, and/or advertising indicia may be molded, adhered, and/or printed.

The means and construction disclosed herein are by way of example and comprise primarily the preferred form of putting the invention into effect. Although the drawings depict a preferred embodiment of the invention, other embodiments have been described within the preceding text. One skilled in the art will appreciate that the disclosed device may have a wide variety of sizes, shapes, and configurations. Additionally, persons skilled in the art to which the invention pertains might consider the foregoing teachings in making various modifications, other embodiments, and alternative forms of the invention.

It is, therefore, to be understood that the invention is not limited to the particular embodiment or specific features shown herein. To the contrary, the inventor claims the invention in all of its forms, including all modifications, equivalents, and alternative embodiments which fall within the legitimate and valid scope of the appended claims, appropriately interpreted under the Doctrine of Equivalents.

INDUSTRIAL APPLICABILITY

The present invention is a musical chime that is intended to be placed upon a desk or counter of a home or office. When not operating, the cabinet and chime bars of the musical chime serve as a sculptural and ornamental decoration. To this end, the cabinet is preferably manufactured of an aesthetically pleasing natural wood, and the chime bars are made of polished aluminum or other resonating metal. Windows are provided along the sides of the cabinet to allow persons to see within the enclosure and observe the inner workings and elements of the invention.

To operate the device, the cabinet is temporarily inverted to cause the chime beads to come into contact with an adhesive strip secured within the enclosure to the top of the cabinet. Once contact is made, the chime beads become adhered to the adhesive strip. The cabinet is again inverted to assume its upright position and is placed upon the desk or counter.

As the force of gravity pulls against the suspended chime beads, the forces of adhesion are weakened. Gradually, the force of gravity overcomes the forces of adhesion and the chime beads fall at random intervals from the adhesive strip.

The chime bars are positioned below the adhesive strip. Consequently, when the chime beads are released from the adhesive strip, the chime beads impact against the underlying chime bars. The chime bars are positioned to both be aesthetically pleasing and to increase the probability that each chime bead will impact with more than one chime bar. To this end, the chime bars are positioned in a stepped, chevron-shaped configuration. Chime beads which impact the outermost chime bars are consequently urged toward the central area of the enclosure to impact against a successively lower or oppositely positioned chime bar. The chime bars are preferably made of solid, cylindrical aluminum material that has high-quality resonating characteristics.

To further enhance the resonating effect of the invention, the interior surfaces of the cabinet against which the chime beads might impact can be covered with an impact-absorbent material, such as with a foam or fabric sheet material. Furthermore, the sidewalls of the cabinet may be provided with apertures therein which allow the resonating sound to further escape from within the enclosure. The cabinet itself also resonates to enhance the quality of the generated musical notes.

As described above, each of the chime bars has a different length and, consequently, a different resonating frequency when impacted. The resulting musical notes are extremely pleasing and soothing to hear.

The apparatus of this invention is very efficient, reliable, compact, rugged, and durable in design. The invention is easily constructed and assembled. The invention is inexpensive and economical to manufacture. Furthermore, the invention is also extremely simple to use, and is compact and unobtrusive during operation.

I claim:

1. An apparatus for placement upon a support surface, said apparatus capable of generating musical notes at random intervals over a period of time (a) a cabinet having a base, a top, and at least one sidewall, said base, said top, and said sidewall defining an enclosure therein, said top being elevated above said base;

(b) an adhesive strip secured to said top within said enclosure;

(c) a plurality of chime beads selectively adhered to said adhesive strip, said adhesive strip permitting said chime beads to fall therefrom under force of gravity; and (d) a plurality of chime bars positioned within said enclosure below said top, said chime bars being secured to said cabinet in a suspended, stepped, chevron-shaped configuration, said chime bars being suspended upon taut cords secured to said cabinet within said enclosure, said cabinet further comprising at least two spaced, parallel oriented, support members further defining said enclosure, said support members being oriented generally orthogonal to said base, to said top, and to said sidewall, said cords being secured to said support members, said cords being stretched taut between said support members.

2. The apparatus of claim 1, wherein said apparatus further comprises at least one support leg positioned between said base and the support surface, said support leg being secured to said base.

3. The apparatus of claim 2, wherein said apparatus further comprises at least one scratch resistant pad positioned between said support leg and the support surface, said pad being secured to said support leg.

4. The apparatus of claim 1, wherein said sidewall has one or more apertures therein.

5. The apparatus of claim 1, wherein said cabinet comprises at least two parallel-spaced sidewalls, said sidewalls further defining said enclosure.

6. The apparatus of claim 1, wherein said cabinet further comprises at least one transparent or translucent window positioned between and generally orthogonal to said base, to said top, and to said sidewalls, said window further defining said enclosure.

7. The apparatus of claim 6, wherein said apparatus comprises at least two said transparent or translucent windows, said windows being positioned in a generally parallel, spaced relationship to one another.

8. The apparatus of claim 1, wherein said top is selectively removable from said base and said sidewall.

9. The apparatus of claim 1, wherein said adhesive strip comprises a strip of double sided adhesive film having a high-tack surface on one side and a low-tack surface on an opposite side thereof.

10. The apparatus of claim 1, wherein said chime beads comprise generally spherial steel orbs.

11. The apparatus of claim 1, wherein said chime bars have a spaced, generally horizontal orientation within said enclosure.

12. The apparatus of claim 1, wherein said chime bars have differing lengths.

13. The apparatus of claim 1, wherein said chime bars are positioned within said stepped, chevron-shaped configuration in such a manner that length of said chime bars decreases with each successive step downward toward said base.

14. The apparatus of claim 1, wherein said support members have a generally stepped configuration which generally converge toward each other near said base.

15. The apparatus of claim 1, wherein each of said chime bars has at least two generally parallel bore holes therein through which said taut cord passes.

16. The apparatus of claim 15, wherein said apparatus comprises a plurality of said taut cords, each of said taut cords supporting at least two said chime bars.

17. The apparatus of claim 16, wherein said support members have generally vertical channels or bore holes therein through which at least one of said taut cords pass, said taut cords being secured to said cabinet to prevent longitudinal movement of said taut cords within said channels or bore holes.

18. The apparatus of claim 17, wherein said apparatus further comprises means for absorbing undesired impact of said chime beads against said cabinet, said impact-absorbent means being adhered, secured, or otherwise affixed to said cabinet.

* * * * *

UNITED STATES PATENT AND TRADEMARK OFFICE

CERTIFICATE OF CORRECTION

PATENT NO. : 5,225,616

DATED : July 6, 1993

INVENTOR(S) : Charles K. Bakeman

It is certified that error appears in the above-identified patent and that said Letters Patent is hereby corrected as shown below:

Column 2, line 6, delete "of" and insert therefor --off--.

Column 3, line 12, delete "their" and insert therefor --its--.

Column 4, line 32, delete "36" (second occurrence) and insert therefor --36'--.

Column 5, line 6, insert --.-- immediately following "22".

Column 7, line 9, delete "58" (second occurrence) and insert therefor --58'--.

Column 7, line 28, delete "68" (second occurrence) and insert therefor --68'--.

Column 7, line 42, insert --interior curved or arcuate planar surface 160 and 160',-- between "an" and "respectively.".

Column 7, line 51, delete "shock-absorbant" and insert therefor --shock-absorbent--.

UNITED STATES PATENT AND TRADEMARK OFFICE

CERTIFICATE OF CORRECTION

PATENT NO. : 5,225,616

DATED : July 6, 1993

INVENTOR(S) : Charles K. Bakeman

It is certified that error appears in the above-identified patent and that said Letters Patent is hereby corrected as shown below:

Column 9, line 58, insert --without intervention by a musician, said apparatus comprising-- after "time".

Signed and Sealed this

First Day of March, 1994

Bruce Lehman

*Attest:*

BRUCE LEHMAN

*Attesting Officer*

*Commissioner of Patents and Trademarks*